US011539151B2

(12) United States Patent
Arnold et al.

(10) Patent No.: US 11,539,151 B2
(45) Date of Patent: Dec. 27, 2022

(54) CIRCUIT ARRANGEMENT CONSISTING OF TWO INTERCONNECTED HIGH-FREQUENCY COMPONENTS

(71) Applicant: Tesat-Spacecom GmbH & Co. KG, Backnang (DE)

(72) Inventors: Christian Arnold, Backnang (DE); Tobias Kässer, Backnang (DE); Michael Franz, Backnang (DE); Tobias Janocha, Backnang (DE); Andre Berger, Backnang (DE); Ralf Kröner, Backnang (DE); Ulrich Mahr, Backnang (DE); Benjamin Falk, Backnang (DE)

(73) Assignee: Tesat-Spacecom GmbH & Co. KG

( * ) Notice: Subject to any disclaimer, the term of this patent is extended or adjusted under 35 U.S.C. 154(b) by 263 days.

(21) Appl. No.: 16/907,673

(22) Filed: Jun. 22, 2020

(65) Prior Publication Data

US 2020/0412036 A1 Dec. 31, 2020

(30) Foreign Application Priority Data

Jun. 28, 2019 (DE) ..... 10 2019 117 473.2

(51) Int. Cl.
*H01R 12/71* (2011.01)
*H01R 103/00* (2006.01)

(52) U.S. Cl.
CPC ..... *H01R 12/712* (2013.01); *H01R 2103/00* (2013.01)

(58) Field of Classification Search
CPC .... H01R 12/712; H01R 2103/00; H01P 5/085
See application file for complete search history.

(56) References Cited

U.S. PATENT DOCUMENTS 4,001,711 A * 1/1977 Knutson ..... H05K 1/165 330/306
5,557,290 A * 9/1996 Watanabe ..... H01Q 1/1285 343/715
5,982,253 A * 11/1999 Perrin ..... H03H 7/427 333/182

(Continued)

FOREIGN PATENT DOCUMENTS

DE 19938074 C2 * 9/2002 ..... H01R 24/525
DE 10260287 A1 8/2003
DE 102017124974 B3 2/2019

*Primary Examiner* — Briggitte R. Hammond
(74) *Attorney, Agent, or Firm* — Lerner, David, Littenberg, Krumholz & Mentlik, LLP

(57) ABSTRACT

A circuit arrangement having two interconnected high-frequency components, namely a first component and a second component, is described. A connection for transferring high-frequency signals is arranged between the first component and the second component. The connection includes at least one inner conductor, which is at least partially enclosed by an outer conductor. The inner conductor is connected to the first component and to the second component in order to transfer high-frequency signals. The second component includes a contact surface on a connecting surface and the inner conductor is pressed using a pressure force onto the contact surface, to establish a high-frequency connection between the first component and the second component.

14 Claims, 3 Drawing Sheets

(56) References Cited

U.S. PATENT DOCUMENTS 6,132,244 A * 10/2000 Leeman ..... H01R 13/6585 439/931
7,118,383 B2 * 10/2006 Nagata ..... H01R 24/50 439/63
7,651,334 B2 * 1/2010 Zhang ..... H01R 24/50 439/63
7,819,694 B2 * 10/2010 Miyashita ..... H01R 24/40 439/585
7,833,054 B2 * 11/2010 Matsumoto ..... H01R 9/053 439/585
7,914,347 B2 * 3/2011 Paulus ..... H01R 24/50 439/680
7,972,174 B2 * 7/2011 Maruyama ..... H01R 24/54 439/582
8,047,871 B2 * 11/2011 Kohnishi ..... H01R 9/0518 439/582
8,618,892 B2 * 12/2013 Iida ..... H01P 5/08 333/156
9,276,364 B2 * 3/2016 Mitsuno ..... H01R 24/50
9,484,688 B2 * 11/2016 Hügel ..... H01R 12/91
9,666,958 B2 * 5/2017 Harwath ..... H01R 24/42
9,774,137 B2 * 9/2017 Park ..... H01R 13/6683
9,806,473 B2 * 10/2017 Kim ..... H01R 43/16
9,843,084 B2 * 12/2017 Sherrer ..... H01P 5/183
10,224,676 B2 * 3/2019 Hemmerlein .... G01R 33/34007
10,446,982 B2 * 10/2019 Fukumoto ..... H01R 13/639
10,468,790 B2 * 11/2019 Imtiaz ..... H01R 9/05
10,826,150 B2 * 11/2020 Rosenberger ..... H01P 5/026
10,992,272 B2 * 4/2021 Arnold ..... H03F 3/21
2002/0081910 A1 * 6/2002 Kihira ..... H01R 12/7082 439/700
2005/0245105 A1 11/2005 Driscoll et al.
2010/0015850 A1 * 1/2010 Stein ..... H01R 24/50 439/581
2011/0003507 A1 * 1/2011 Van Swearingen .... H01Q 1/246 164/76.1
2013/0069835 A1 * 3/2013 Swais ..... H01Q 1/3275 333/32
2013/0330944 A1 12/2013 Rucki et al.
2015/0004828 A1 * 1/2015 Osada ..... H01R 13/639 439/357
2015/0132997 A1 * 5/2015 Mitsuno ..... H01R 24/50 439/675
2016/0233611 A1 * 8/2016 Sato ..... H01R 24/005
2017/0142824 A1 5/2017 Puzella et al.
2018/0212363 A1 * 7/2018 Fukumoto ..... H01R 9/0515
2019/0036240 A1 * 1/2019 Imtiaz ..... H01R 24/50
2019/0123447 A1 4/2019 Arnold et al.
2020/0169018 A1 * 5/2020 Aoki ..... H01R 12/716

* cited by examiner

CIRCUIT ARRANGEMENT CONSISTING OF TWO INTERCONNECTED HIGH-FREQUENCY COMPONENTS

FIELD OF THE INVENTION

The present invention relates in general to the technical field of high-frequency technology and relates in general to a circuit arrangement consisting of two interconnected high-frequency components and also a satellite having such a circuit arrangement.

BACKGROUND OF THE INVENTION

In high-frequency technology, i.e., for the transmission and processing of signals having very high frequencies, for example, signals significantly greater than 1 GHz up to 35 to 40 GHz, waveguides or coaxial lines are typically used. Such high-frequency connections can be used, for example, as a component of satellite transmission links. The satellite transmission link can be, for example, a Ka band transmission link in a frequency range of 17.7-21.2 GHz for the downlink and 27.5-31 GHz for the uplink, a Ku or X band implementation in the range around 11 or 7 GHz, respectively, or an L band (around 1.5 GHz), S band (around 2.5 GHz), or C band implementation (around 4 GHz).

With the increasing propagation of satellite constellations in low and medium Earth orbit, the requirements for the devices on the payload are increasingly changing toward lower costs and higher piece counts. In general, small, efficient electronic assemblies are required for constellations, for example, to control active antennas. These electronic assemblies are generally equipped with high-frequency amplifiers and the controller thereof, and also passive high-frequency components (filters, junctions, insulators, couplers, etc.). In particular in active antenna structures, these assemblies generally consist of multiple parallel processing paths and are connected at the input to an external circuit board (usually referred to as a "backplane"). This backplane is generally a further HF substrate in a housing and contains the signal processing level for the active antenna or another functional component.

To connect the electronic assemblies to the backplane, a suitable connection is necessary, which meets at least one, preferably all of the following requirements: suitability for high-frequency and direct-current connection; pluggable connection; mechanical and thermo-mechanical stability; little to no connecting force necessary, because generally multiple individual connections (up to several hundred) are established simultaneously, which, even with a low plugging force per individual connection, can require a high force of several hundred or thousand newtons for the entire connection.

DE 10 2017 124 974 B3 describes a possibility of a modular connection between two high-frequency components, wherein the modular connection comprises two interfaces at each of which an active or passive high-frequency component or a high-frequency line can be connected.

BRIEF SUMMARY OF THE INVENTION

Aspects of the invention may enable establishing of a connection between two high-frequency components having multiple individual connections, wherein the above-mentioned requirements are met and in addition a low force is required for establishing the connection.

According to a first aspect, a circuit arrangement is specified. The circuit arrangement comprises two interconnected high-frequency components, namely a first component and a second component. A connection for transferring high-frequency signals between the first component and the second component is arranged between the first component and the second component, i.e., for transferring high-frequency signals from the first component to the second component and/or vice versa. The connection comprises at least one inner conductor, wherein the inner conductor is at least partially enclosed by an outer conductor and wherein the inner conductor is connected, on the one hand, to the first component and, on the other hand, to the second component, in order to transfer high-frequency signals. The second component comprises a contact surface on a connecting surface, wherein the inner conductor is pressed using a pressure force onto the contact surface to establish a high-frequency connection between the first component and the second component.

In conjunction with this description, the term "connected" or "connection" is to be understood to mean that it is a communicative connection for transferring signals, in particular high-frequency signals, in this case. This does not preclude that a "connection" can also be a mechanical connection, however, if not explicitly indicated or designated otherwise, a signal transfer connection is always present when the general term "connection" is used.

The term "signal" is also to be understood to mean that in this case these are high-frequency signals, as mentioned above in the introductory part, unless a signal is explicitly defined differently at a point.

The inner conductor thus has a first end, which is connected to the functional module of the first component. This first end can be connected to the functional module, for example, via a microstrip line, one or more welded bonds, one or more soldered bonds, or the like. However, it is also conceivable that the first end is connected to the functional module of the first component via a contact surface, onto which the inner conductor is pressed.

The functional module of the first component can be, for example, a signal processing unit, an amplifier, or a similar element, which is arranged in a signal path of a high-frequency signal. In this signal path, the first end of the inner conductor can be considered to be a signal input.

The second end of the inner conductor is connected to the second component or a functional module located therein or connected thereon, by pressing onto the contact surface of the connecting surface of the second component. The second end can be considered to be a signal output. However, signals can be transferred via the inner conductor in both directions.

The structure of the circuit arrangement described herein enables two HF components to be connected with significant mechanical decoupling of the two components. The inner conductor and possibly also the outer conductor are solely pressed onto the contact surfaces and are not mechanically coupled otherwise. The connected components are thus mechanically and thermo-mechanically decoupled.

The end face of the inner conductor is preferably smaller than the total area of the contact surface contacted by the inner conductor, i.e., the inner conductor rests completely on the contact surface in a starting position and the contact surface protrudes laterally in all directions beyond the end face of the inner conductor. Even if the inner conductor has a small lateral offset or moves in a lateral direction, for example, because of thermal expansion of a component, the inner conductor still rests completely on the contact surface.

According to one embodiment, the contact surface is a metallized surface on the connecting surface of the second component, wherein the contact surface is connected to a functional module of the second component, so that a transfer of signals from the functional module of the first component to the functional module of the second component is enabled.

The contact surface can be produced, for example, by means of an electrically conductive metallized adhesive. This adhesive can be applied to a predetermined surface region of the second component, so that the inner conductor can establish a galvanic connection via the contact surface. The contact surface can also be implemented by means of an electrically conductive pad, however, which is arranged on a surface of the second component. The contact surface can be elastically deformable by a small amount, so that the contact surface is elastically deformed when the inner conductor is pressed onto the contact surface, in order to establish a signal-conducting connection.

The contact surface can be arranged, for example, on a surface of a circuit board or printed circuit board. A signal line leads from the contact surface inward into the circuit board, so that the signal transferred from the inner conductor to the contact surface is tapped for further processing.

According to a further embodiment, the outer conductor is galvanically connected at least at some points to a further contact surface on the connecting surface.

This means that the outer conductor is pressed onto a contact surface on the second component to establish a galvanic connection. An end face of the outer conductor is located at least on one contact surface (or even on multiple contact surfaces), which is referred to as a point connection. The end face of the outer conductor can have a cross section which exceeds the cross-sectional area of the contacted contact surface in at least one direction. It is also conceivable that a contact surface, which corresponds to the shape of the outer conductor, is provided for the outer conductor.

The outer conductor can enclose the inner conductor, for example, in a circular or rectangular manner. This accordingly means that a contact surface for the outer conductor, which corresponds to the shape of the outer conductor, i.e., circular or rectangular according to the above example, can be arranged around the contact surface for the inner conductor.

The outer conductor can have the function of electromagnetically shielding the inner conductor from the environment. For this purpose, it is advantageous if the outer conductor completely encloses the inner conductor in a galvanically conductive manner on the surface of the second component, thus if the contact surface for the outer conductor completely encloses the contact surface of the inner conductor.

According to a further embodiment, the circuit arrangement furthermore comprises a dielectric material, which is arranged between the inner conductor and the outer conductor.

The dielectric material can be a plastic, for example, Teflon or a polyether ether ketone, PEEK.

According to a further embodiment, the first component comprises a housing, wherein the inner conductor and the outer conductor extend in an identical direction away from the housing and in the direction of the second component, wherein the outer conductor is galvanically connected to the housing.

The outer conductor can be integrally formed with the housing. However, it is also conceivable that the outer conductor is pressed onto the housing and establishes a galvanic connection to the housing via a contact surface.

An opening for the inner conductor is provided in the housing, so that the inner conductor can receive a signal from a functional assembly (for example, an amplifier) arranged in the housing and can conduct it outward to the second component (the backplane). The inner conductor is enclosed by the dielectric material in the opening and is thus galvanically isolated from the housing. The dielectric material can also have the function of holding and fixing the inner conductor in relation to the housing and the opening through which the inner conductor extends.

The housing can comprise a plurality of openings for an equal plurality of inner conductors and associated outer conductors. Preferably, all inner conductors and outer conductors protrude from the same surface of the housing and in the same direction, so that the first housing can be pressed easily onto the second component and fixed thereon, so that each individual inner conductor (and outer conductor) establishes a separate connection to the second component.

The housing can be manufactured, for example, from aluminium or an aluminium alloy.

According to a further embodiment, the end faces of inner conductor and outer conductor protruding from the housing have an equal distance from an outer surface of the housing.

The inner conductor and the outer conductor thus contact a pressed-on backplane at the same time, presuming that the backplane is pressed on at an angle perpendicular to the inner conductor and outer conductor. In this way, it can be ensured that the inner conductor and the outer conductor establish a galvanic connection to the second component in each case. If multiple inner and outer conductors are provided, they preferably all have the same distance to a planar lateral surface of the housing.

According to a further embodiment, the first component comprises a plurality of inner conductors and a plurality of outer conductors, wherein one outer conductor is arranged between each two adjacent inner conductors.

The outer conductor is used to shield the inner conductor from electromagnetic influences of adjacent inner conductors.

According to a further embodiment, at least a part of the inner conductors of the plurality of inner conductors (i.e., some inner conductors of the total number, but not necessarily all) is embedded in a plastic block and held immovably in relation to one another.

Recesses for the outer conductor(s) can be provided in the plastic block, so that the plastic block including inner conductors can be placed on the outer conductors and the housing of the first component or on the second component and held thereon.

According to a further embodiment, a plurality of contact surfaces is arranged on an outer surface of the first component facing toward and opposite to the connecting surface of the second component, wherein a corresponding number of contact surfaces is arranged on the connecting surface. An inner conductor or an outer conductor extends between opposing contact surfaces of the outer surface and the connecting surface, wherein inner conductor and outer conductor are pressed onto the contact surfaces of outer surface and connecting surface using a pressure force.

In this embodiment, inner conductor and outer conductor are mechanically isolated from the first and second component and are, in the assembled form of the circuit arrangement, solely pressed by the pressure force in each case onto two opposing contact surfaces to establish a connection between the first and second component.

This means that the inner conductor and the outer conductor extend perpendicularly from an outer surface of the first component (i.e., of the housing of the first component) and meet the connecting surface of the second component perpendicularly. This can be the case in all embodiments, wherein it is advantageous in particular in those embodiments in which, except for the exerted pressure force, there is no mechanical fixation of the inner and outer conductors with respect to the first and second component.

According to a further embodiment, at least two positioning elements are arranged on the first component or on the second component, wherein recesses are arranged on the other component, which are designed to accommodate the positioning elements and bring the first component into a predetermined position with respect to the second component and hold it in the predetermined position.

The positioning elements can be register pins or the like. In particular because inner conductor and outer conductor have to be pressed with comparatively high positioning accuracy onto the connecting surface, the positioning elements offer a good assistance for the assembly of the circuit arrangement. The positioning elements are pressed into the recesses, which can be designed as depressions or passages in the other component, so that the first component assumes a provided position in relation to the second component.

According to a further embodiment, the circuit arrangement further comprises at least one connecting element, which is arranged to exert a pressure force on the first component and/or second component, so that the first component is pressed in the direction of the second component and is held using a predetermined pressure force.

The connecting element thus exerts the required force so that a galvanic connection is established between the inner and outer conductors and the associated contact surface and is held for the transfer of high-frequency signals. The connecting element can be, for example, a clamp or a screw connection. Multiple connecting elements can be provided, which press the first and second component against one another at different positions and spaced apart from one another, so that a uniform pressure force is provided over the entire area of the first and second component.

According to a further embodiment, the outer conductor is designed as a grid structure or honeycomb structure and is arranged between the first component and the second component, wherein the outer conductor forms a plurality of chambers and each chamber is at least partially enclosed by the material of the outer conductor, wherein an inner conductor is arranged in each chamber.

In this form, the outer conductor can be arranged as a whole between first and second component and connected to one of these components. The dielectric material and the inner conductor can then be positioned in the chambers. A high positioning accuracy of the inner conductors and outer conductors is thus ensured and the number, position, and shape of inner conductors and outer conductors can be adapted to a desired backplane.

According to a further embodiment, a dielectric material, which at least partially encloses the inner conductor in the chambers, is arranged in at least a part of the chambers (in at least some chambers).

One chamber is preferably completely filled with dielectric material. Alternatively, no dielectric material at all can be arranged in the chambers.

According to a further embodiment, the inner conductor is arranged spaced apart from the outer conductor in a chamber or is galvanically coupled to the outer conductor at a lateral surface of a chamber.

The inner conductor can be arranged centred in a chamber. This means that the inner conductor is galvanically isolated from the outer conductor. High-frequency signals and direct-current signals can thus be transferred via the inner conductor. However, it is also conceivable that the inner conductor is galvanically coupled to an inner wall of a chamber. In this case, only high-frequency signals can be transferred.

If the inner conductor is galvanically applied to the outer conductor, it is designed, for example, like a ridge or an elevation in relation to an inner wall of a chamber. In this embodiment, the inner conductor is galvanically connected at at least one point or one position to the outer conductor.

The inner conductor is electrically conductive and is designed to transfer a high-frequency signal. In the variant in which the inner conductor is galvanically connected to the outer conductor, the inner conductor can also be at least partially enclosed by an insulator and/or dielectric material. The insulator and/or the dielectric material are in turn enclosed by the material of the outer conductor.

A gap is thus formed along the longitudinal direction of the inner conductor between the inner conductor and the outer conductor along at least one lateral surface of the outer conductor, within which gap a high-frequency signal can propagate in the longitudinal direction of the inner conductor.

According to a further aspect, a satellite having a circuit arrangement as described herein is specified, wherein the circuit arrangement is coupled, on the one hand, to a signal processing unit of the satellite and, on the other hand, to a functional module of the satellite.

The signal processing unit can be an amplifier or a signal source, which provides signals to be transferred to the circuit arrangement. These signals are then transferred via the connection to the backplane. From the backplane, the signals can then be transferred to further signal processing units for further processing or to an antenna for a wireless transmission.

Further designs of the switching device are described with reference to the following drawings.

BRIEF DESCRIPTION OF THE DRAWINGS

The exemplary embodiments of the invention will be described in greater detail hereafter with the aid of the appended drawings. The illustrations are schematic and are not true to scale. Identical reference signs relate to identical or similar elements. In the figures.

DETAILED DESCRIPTION

Figure 1:
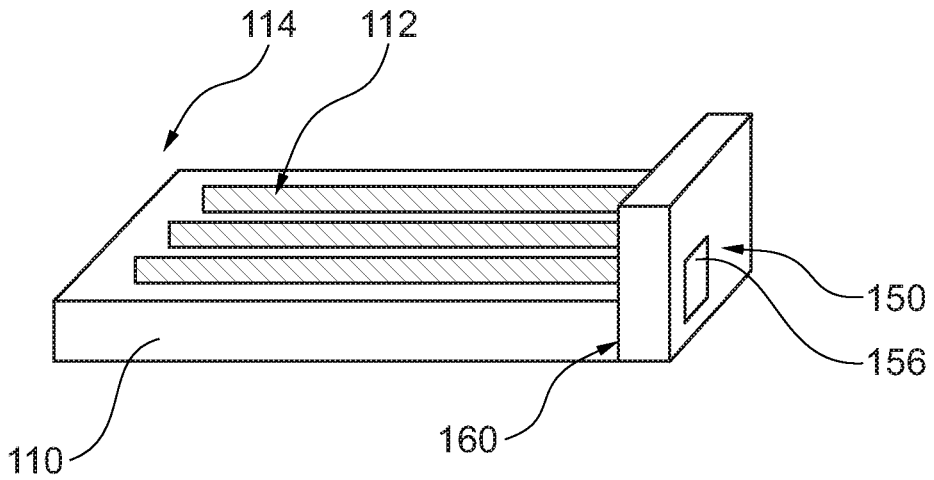
FIG. 1 shows a schematic illustration of two interconnected high-frequency components.

FIG. 1 shows by way of example an electronic module having a first component 110 and a second component 150. The two components 110, 150 are each arranged on a circuit board, wherein the circuit board of the first component 110 extends from left to right and into the plane of the drawing and the circuit board of the second component 150 extends perpendicularly thereto.

The first component 110 comprises processing modules 112. The processing modules receive (or transmit, depending on the direction of the signal processing path) signals via a signal interface 114. The first component 110 is connected via a connection 160 to the second component 150.

A functional module 156 is arranged on the second component 150. The functional module can independently execute signal processing functionality or solely relay the signals to a processing unit. In any case, a signal is fed from the first component 110 via the connection 160 to the second component 150 (or vice versa).

Figure 2:
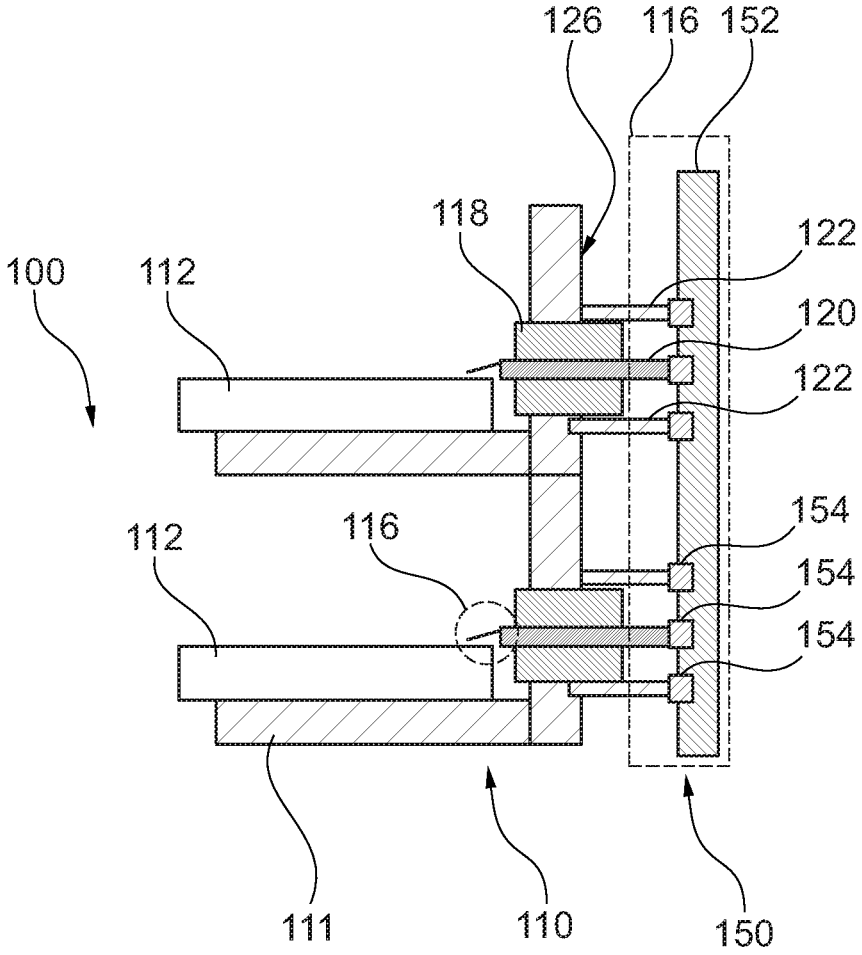
FIG. 2 shows a schematic illustration of a circuit arrangement according to one exemplary embodiment in a lateral sectional view.

FIG. 2 schematically shows a circuit arrangement 100 according to one exemplary embodiment. The circuit arrangement 100 comprises a first component 110 and a second component 150, which are interconnected via a connection 116.

The first component 110 comprises a housing 111 (shaded). Processing modules 112 (one or more, two are shown) are contained in the housing. Openings are arranged in a side wall of the housing 111 to conduct signals from the processing modules 112 outward via an inner conductor 120. In the present case, the inner conductors 120 are connected via a microstrip line (bonding). The inner conductor 120 is enclosed by a dielectric material 118 in the opening of the housing and protrudes outward from the outer surface 126. Each inner conductor 120 is enclosed by an outer conductor 122. The outer conductor protrudes from the outer surface 126 of the housing in the same direction as the inner conductor 120.

The first component 110 is aligned with respect to a second component, of which only a connecting surface 152 is shown in FIG. 2, so that the inner conductor 120 and the outer conductor 122 touch provided contact surfaces 154 and establish a connection thereto when the first component 110 and the second component 150 are pressed against one another, thus when the connecting surface 152 and the outer surface 126 are moved toward one another.

The circuit arrangement contains and connects two HF modules (first and second components 110, 150), wherein in some variants both HF and also DC signals can be transferred. The HF modules can be arranged perpendicularly in relation to one another in this case (for example, to connect a backplane and an amplifier module for active antennas). The connection is established by an inner conductor inserted into plastic (for example, Teflon or PEEK, the dielectric material 118). This inner conductor can either be embedded in the plastic or pressed in or inserted later. Either a single inner conductor embedded in plastic or a block of inner conductors (having metallic partition surfaces between the individual inner conductors, which can also be embedded) can be used. This structure is schematically shown in FIG. 2.

The first component 110 consists of a group of electronic modules 112, of which one or more (for example, four) are installed in a housing 111 (for example, produced from aluminium). The housing 111 has feedthroughs, which are designed so that they represent the connection to the backplane for the outer conductor (in the figure, the housing part 122 connected to the backplane). The inner conductor 120 embedded in dielectric material 118 is inserted into this feedthrough. Inner conductor and dielectric material are designed so that a displacement of the inner conductor under pressure load from right to left (in relation to the illustration in FIG. 2, i.e., into the housing 111) is prevented. The inner conductor is connected to the electronic assembly 112 (for example, bonding, soldering, gap welding). The connection to the backplane 150 is produced with the aid of contact surfaces, these are, for example, electrically conductive polymers or silicones (e.g., Nolato, Invisipin). The housing, in which the backplane is installed, is aligned with the housing 111 for this purpose (for example, using register pins, see FIG. 8) and then permanently connected (e.g., screwed on, clamped, or adhesively bonded). The backplane is installed as a whole from the right in FIG. 2.

A connection via contact surfaces enables a flexible connection which ensures the electrical conductivity over a large temperature range. Mechanical decoupling is also achieved. The force required for the contacting is low, only a certain pre-tension has to be ensured to achieve a secure contact (during the installation of the backplane 150 on the housing 111 of the first component 110).

Figure 3:
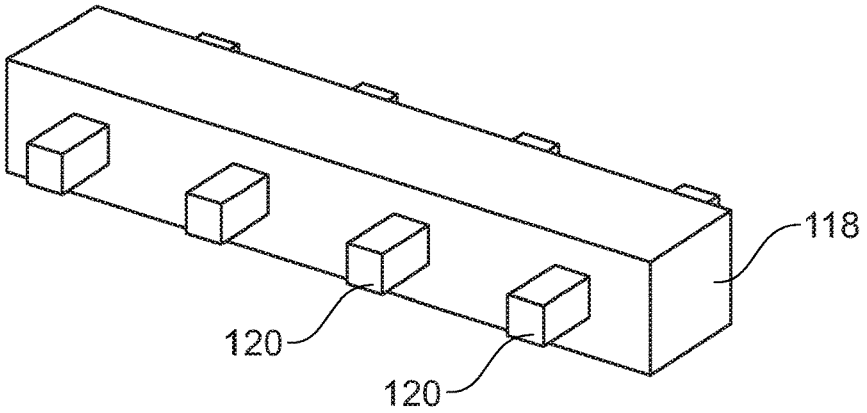
FIG. 3 shows a schematic illustration of inner conductors in a dielectric material.

FIG. 3 shows a schematic illustration of a plurality of inner conductors 120, which are fitted or embedded in a plastic block 118, which functions as a dielectric material. The entire structure shown in FIG. 3 can thus be arranged between the first component 110 and the second component 150. In addition, measures are also to be taken to be able to attach the outer conductors. For this purpose, recesses or depressions can be provided in the plastic block 118, so that the outer conductors find space therein.

The inner conductors 120 can be arranged in the plastic block 118 at provided distances, so that the inner conductors touch the provided contact surfaces exactly upon placement of the arrangement from FIG. 3.

Figure 4:
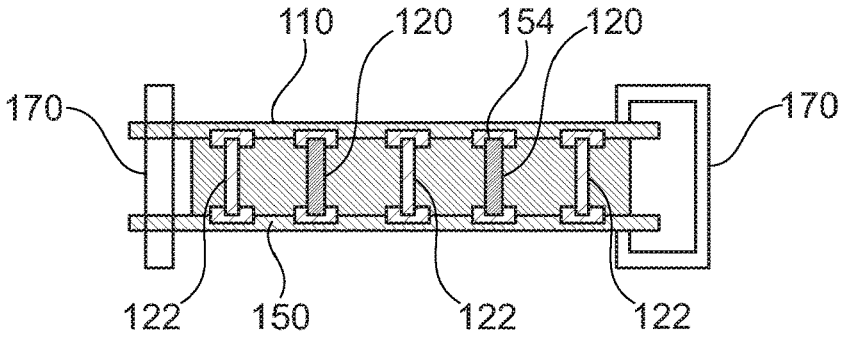
FIG. 4 shows a schematic sectional illustration of a circuit arrangement according to one exemplary embodiment.

FIG. 4 shows by way of example how a first component 110 and a second component 150 can be interconnected according to the connection technology provided here. Inner conductors 120, outer conductors 122, and dielectric material 118 are arranged between the components 110, 150 (which are each designed as a circuit board in this case). Each inner conductor is enclosed by two outer conductors, and/or one outer conductor is located between each two adjacent inner conductors. The intermediate spaces are filled using dielectric material. The upper circuit board 110 and the lower circuit board 150 are pressed against one another by connecting elements 170 in the form of a screw connection (left) and a clamp connection (right), so that the inner conductors and outer conductors touch the contact surfaces 154 on the upper circuit board and the lower circuit board and thus establish a high-frequency signal connection.

FIG. 4 thus shows that the connection technology described herein can also be used to directly interconnect two circuit boards. However, a circuit board can also be connected using an output to an antenna, which is located above the circuit board.

Figure 5:
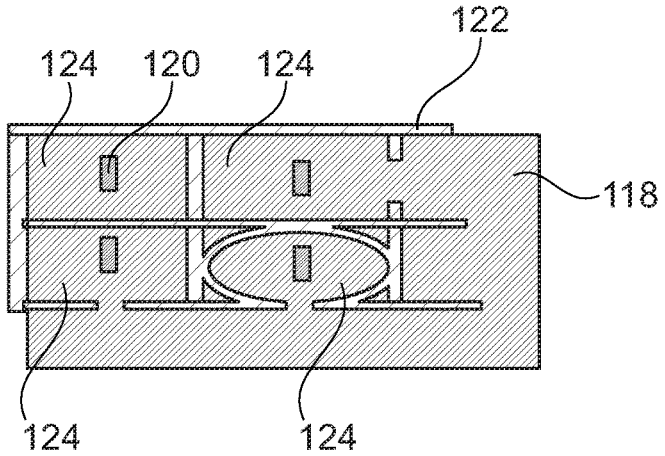
FIG. 5 shows a schematic top view of a partially assembled circuit arrangement according to one exemplary embodiment.

FIG. 5 shows the connection of FIG. 4 in a partially assembled state. This is a top view of the arrangement of FIG. 4, wherein the upper circuit board 110 is not yet installed. The dielectric material 118 and the structure of the outer conductor 122 and also the position of the inner conductor 120 with respect to the outer conductor 122 can be seen.

The outer conductor 122 is provided in the form of a grid structure or honeycomb structure. The outer conductor thus forms a plurality of chambers 124, which are partially or entirely enclosed by the material of the outer conductor forming the grid structure. At the top left in FIG. 5, the chamber is completely enclosed by the outer conductor, while in contrast the other three chambers shown are open at least in sections on a side wall. The openings are preferably at those positions from which electromagnetic disturbances or interference do not threaten the respective inner conductor.

The inner conductors 120 are arranged horizontally and vertically in the middle in the chambers (the direction specifications relate to the directions in FIG. 5). However, it is also conceivable that the inner conductors are offset in one or both directions from the middle.

In any case, the inner conductors are arranged in relation to the outer conductor so that they contact correspondingly arranged contact surfaces on the circuit boards 110, 150. For this purpose, the assembly made up of outer conductor 122, dielectric material 118, and inner conductor 120 from FIG. 5 is firstly positioned on the lower circuit board 150 (and if necessary fixed against lateral displacement, possibly using register pins, cf. FIG. 8), the upper circuit board 110 is then placed on the assembly made of outer conductor 122, dielectric material 118, and inner conductor 120 and also positioned, so that inner conductor and outer conductor contact the associated contact surfaces of the upper circuit board.

Finally, a pressure force is applied to the circuit boards using connecting elements or retaining elements 170.

Figure 6:
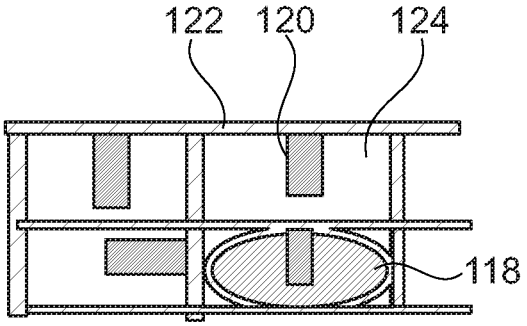
FIG. 6 shows a schematic illustration of inner conductors and one outer conductor.

FIG. 6 shows an alternative design of the arrangement from FIG. 5. In the example of FIG. 5, the inner conductors 120 are arranged spaced apart from the walls of the chambers 124 of the outer conductors 122 (grid structure) in the chambers. In the example of FIG. 6, in contrast, the inner conductors 122 press against a wall of a chamber. In this case, the inner conductors 120 are galvanically connected at at least one position to the outer conductor 122. Moreover, a gap can be provided between inner conductor and outer conductor, in which a high-frequency wave propagates and is thus transferred.

A chamber can optionally be filled using dielectric material 118, as shown in the chamber at the bottom right in FIG. 6. The other three chambers are not filled using dielectric material.

The inner conductors can be arranged on the walls of the chambers so that one inner conductor is not arranged in each case on the same wall on different sides of the wall. This can keep the mutual influence of signals on one another low. As shown in FIG. 6, the two inner conductors on the right side are each arranged on the upper wall of the chamber thereof. The inner conductor on the top left is arranged on the upper wall of its chamber and the inner conductor on the bottom left is arranged on the right wall of its chamber. In any case, many constellations are conceivable for the attachment of the inner conductors to the walls of the chambers, to avoid two inner conductors being arranged on opposing sides of the same chamber wall. To illustrate the state which one seeks to avoid if possible: if the inner conductor in the chamber on the bottom right is arranged on the left inner wall of its chamber, then the inner conductors in the two lower chambers are arranged on opposing sides of the same chamber wall and are very close to one another, so that interference possibly occurs.

Figure 7:
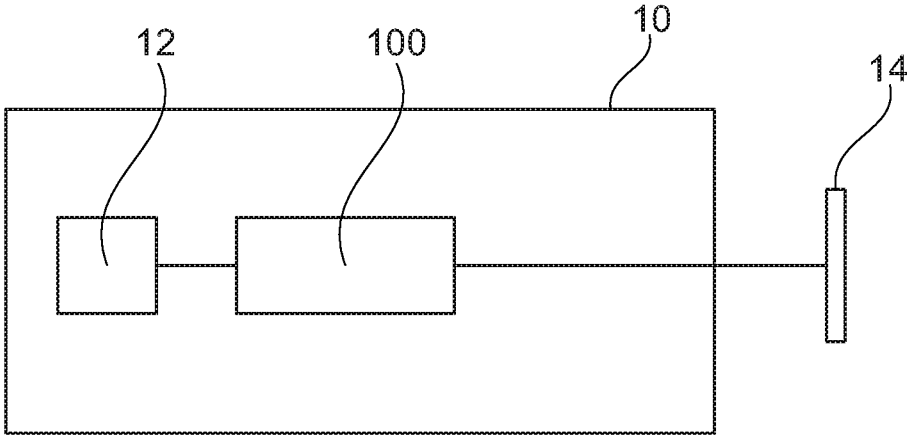
FIG. 7 shows a schematic illustration of a satellite having a circuit arrangement according to one exemplary embodiment.

FIG. 7 schematically shows a satellite 10, which contains a circuit arrangement 100 according to one of the examples described herein. The circuit arrangement 100 receives signals from the signal processing unit 12 and transfers them further to a functional module 14, which is designed in the example 14 as an antenna.

The circuit arrangement 100 enables a plurality of channels to be transferred via a mechanically and thermomechanically decoupled connection, as described in detail above.

Figure 8:
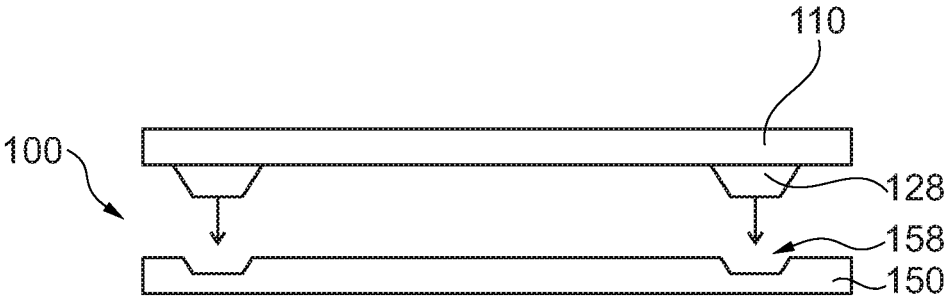
FIG. 8 shows a schematic illustration of a circuit arrangement according to one exemplary embodiment.

FIG. 8 shows by way of example how the first component 110 and the second component 150 can be brought into a predetermined or desired position in relation to one another and can be retained so that the inner conductors and outer conductors contact the associated contact surfaces (and only these and no other contact surfaces).

Multiple positioning elements 128 in the form of register pins in the design as truncated cones, which taper in the direction of the second component 150, are provided on a surface of a component which faces toward the other component and which is used as a connecting surface (in the example of FIG. 8, this is the lower side of the first component 110). The positioning elements 128 can assume diverse shapes and the number thereof can be two or more.

Recesses 158 in the form of depressions or holes, which correspond in the shape and number thereof to the positioning elements, are provided in the opposing surface of the other component (in FIG. 8, this is the second component 150).

If the two components 110, 150 are now moved toward one another, as the two arrows indicate, the positioning elements 128 are accommodated in the depressions 158 and aligned in relation to one another, so that the inner conductors and outer conductors between the two components contact the respective provided contact surfaces and enable high-frequency signals to be transferred.

In addition, it is to be noted that "comprising" does not preclude other elements or steps and "a" or "one" does not preclude a plurality. Furthermore, it is to be noted that features or steps which have been described with reference to one of the above exemplary embodiments can also be used in combination with other features or steps of other above-described exemplary embodiments. Reference signs in the claims are not to be understood as a restriction.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

LIST OF REFERENCE SIGNS

10 satellite
12 signal processing unit
14 functional module, antenna
100 circuit arrangement
110 first component
111 housing

112 processing module
114 interface
116 connection
118 dielectric material
120 inner conductor
122 partition surface, outer conductor
124 chamber
126 outer surface
128 positioning element, register pin
150 second component
152 connecting surface
154 contact surface
158 depression, recess
156 functional module
160 connection
170 connecting element, retaining element

The invention claimed is:

1. A circuit arrangement comprising a first high-frequency component and a second high-frequency component interconnected with each other, wherein a connection for transferring high-frequency signals between the first high-frequency component and the second high-frequency component is arranged between the first high-frequency component and the high-frequency second component;

wherein the connection comprises at least one inner conductor;

wherein the inner conductor is at least partially enclosed by an outer conductor;

wherein the inner conductor is connected to the first high-frequency component and to the second high-frequency component, in order to transfer high-frequency signals;

wherein the second high-frequency component comprises a contact surface on a connecting surface;

wherein the inner conductor is pressed using a pressure force onto the contact surface to establish a high-frequency connection between the first high-frequency component and the second high-frequency component, wherein the first high-frequency component comprises a housing;

wherein the inner conductor and the outer conductor extend in an identical direction away from the housing and in the direction of the second high-frequency component; and wherein the outer conductor is galvanically connected to the housing.

2. The circuit arrangement according to claim 1, wherein the first high-frequency component comprises a first functional module;

wherein the second high-frequency component comprises a second functional module;

wherein the contact surface is a metallized surface on the connecting surface of the second high-frequency component; and wherein the contact surface is connected to the second functional module of the second high-frequency component, so that a transfer of signals from the first functional module of the first component to the second functional module of the second high-frequency component is enabled.

3. The circuit arrangement according to claim 1, wherein the outer conductor is galvanically connected at least at some points to a further contact surface on the connecting surface.

4. The circuit arrangement according to claim 1, further comprising a dielectric material arranged between the inner conductor and the outer conductor.

5. The circuit arrangement according to claim 1, wherein the end faces of inner conductor and outer conductor protruding from the housing have an equal distance from an outer surface of the housing.

6. The circuit arrangement according to claim 1, wherein the at least one inner conductor comprises a plurality of inner conductors associated with the first high-frequency component and the outer conductor comprises a plurality of outer conductors, wherein one of the plurality of outer conductors is arranged between each two adjacent inner conductors of the plurality of the inner conductors.

7. The circuit arrangement according to claim 6, wherein at least a part of the inner conductors of the plurality of inner conductors is embedded in a plastic block and held immovably in relation to one another.

8. The circuit arrangement according to claim 1, wherein a plurality of contact surfaces is arranged on an outer surface of the first high-frequency component facing toward and opposite to the connecting surface of the second high-frequency component;

wherein a corresponding number of contact surfaces is arranged on the connecting surface;

wherein alternately one inner conductor of the at least one inner conductor or one outer conductor of the outer conductor extends between opposing contact surfaces of the outer surface and the connecting surface; and wherein the one inner conductor and the one outer conductor are pressed onto the contact surfaces of outer surface and connecting surface using a pressure force.

9. The circuit arrangement according to claim 1, wherein at least two positioning elements are arranged on one of the first high-frequency component or the second high-frequency component; and wherein recesses are arranged on the other one of the first high-frequency component or the second high-frequency component, wherein the recesses are configured to correspondingly accommodate the at least two positioning elements and to bring the first high-frequency component into a predetermined position with respect to the second high-frequency component and hold the first high-frequency component in the predetermined position.

10. The circuit arrangement according to claim 1, further comprising at least one connecting element arranged to exert a pressure force on the first high-frequency component and/or the second high-frequency component, so that the first high-frequency component is pressed in a direction of the second high-frequency component and is held using a predetermined pressure force.

11. A circuit arrangement comprising a first high-frequency component and a second high-frequency component interconnected with each other, wherein a connection for transferring high-frequency signals between the first high-frequency component and the second high-frequency component is arranged between the first high-frequency component and the high-frequency second component;

wherein the connection comprises at least one inner conductor;

wherein the inner conductor is at least partially enclosed by an outer conductor;

wherein the inner conductor is connected to the first high-frequency component and to the second high-frequency component, in order to transfer high-frequency signals;

wherein the second high-frequency component comprises a contact surface on a connecting surface;

wherein the inner conductor is pressed using a pressure force onto the contact surface to establish a high-frequency connection between the first high-frequency component and the second high-frequency component, wherein the outer conductor is configured as a grid structure or honeycomb structure and is arranged between the first high-frequency component and the second high-frequency component;

wherein the outer conductor forms a plurality of chambers and each chamber is at least partially enclosed by a material of the outer conductor; and wherein an inner conductor of the at least one inner conductor is arranged in each chamber.

12. The circuit arrangement according to claim 11, wherein a dielectric material, which at least partially encloses the inner conductor in the chambers, is arranged in at least a part of the chambers.

13. The circuit arrangement according to claim 11, wherein the at least one inner conductor is arranged spaced apart from the outer conductor in a chamber or is galvanically coupled to the outer conductor at a lateral surface of a chamber.

14. A satellite having a circuit arrangement according to claim 1, wherein the circuit arrangement is coupled to a signal processing unit of the satellite and to a functional module of the satellite.

* * * * *